United States Patent [19]

Stoddard et al.

[11] 4,191,012

[45] Mar. 4, 1980

[54] WET OXIDATION ENGINE

[76] Inventors: Xerxes T. Stoddard, 4617 W. 27th Ave., Denver, Colo. 80215; Vesper A. Vaseen, 9840 W. 35th Ave., Wheat Ridge, Colo. 80033; Ruel C. Terry, 3090 S. High St., Denver, Colo. 80210

[21] Appl. No.: 923,396

[22] Filed: Jul. 10, 1978

[51] Int. Cl.[2] ..... F02G 3/00

[52] U.S. Cl. ..... 60/39.05; 210/63 R

[58] Field of Search ..... 60/39.02, 39.05, 39.53, 60/39.55; 210/63 R

[56] References Cited

U.S. PATENT DOCUMENTS

| | | | |
|---|---|---|---|
| 2,665,249 | 1/1954 | Zimmermann | 210/63 R |
| 3,626,874 | 12/1971 | Grant | 60/39.05 |
| 4,100,730 | 7/1978 | Pradt | 60/39.05 |

OTHER PUBLICATIONS

Zimmerman, F. J., *New Waste Disposal Process,* Chemical Engineering, Aug. 25, 1958, pp. 117–118.

*Primary Examiner*—Louis J. Casaregola
*Attorney, Agent, or Firm*—Ruel C. Terry

[57] ABSTRACT

A reactor vessel is established wherein a fuel is oxidized within an inert oxygen-carrier liquid. A portion of the heat of oxidation is used to raise steam. In one embodiment a double acting engine is interconnected to the reactor vessel wherein the first stroke of the piston is actuated by exhaust gases from the products of oxidation and the return stroke of the piston is actuated by the said steam. In other embodiments generated gases are used to power a turbine and a gas lift pump.

10 Claims, 2 Drawing Figures

WET OXIDATION ENGINE

BACKGROUND OF THE INVENTION

This invention relates to wet oxidation of a fuel and the conversion of released energy into mechanical work. More particularly a fuel is wet oxidized in an inert carrier liquid with the products of oxidation being used to actuate one stroke of a double-acting reciprocating engine. A portion of the heat of oxidation is utilized to raise steam, which in turn is used to actuate the reverse stroke in the double-acting reciprocating engine. In alternate embodiments generated gases are used to drive a turbine and a gas lift pump.

It is well known in the art that materials with a chemical oxygen demand can be oxidized in a wet medium, and that virtually complete oxidation of such materials can be accomplished at temperatures below 610° F. If the material is a solid—such as pulverized coal, wood saw dust or municipal refuse—it is generally preferable to keep the wet medium in the liquid phase so that the material may be kept separated and suspended for reaction with an oxidizer such as oxygen, oxygen enriched air and air. It is also generally preferable that the wet medium be inert to the oxidation reaction as well as to the products of oxidation.

One common wet medium is water which serves satisfactorily within the temperature range for practical wet oxidation, that is, 100° F. to 610° F. At temperatures of 100° F. or lower, the oxidation rate is generally too slow to be of commercial interest in most materials that in effect serve as fuels. At temperatures in the upper end of the range, the use of water as the wet medium tends to become impractical due to the pressures required to keep water in the liquid phase. At temperatures near the upper end of the range, pressures in the order of 3200 psia are required to keep water in liquid form. Pressure vessels required to hold pressures of this magnitude are generally too costly for any practical use of wet oxidation processes.

The importance of keeping the wet medium in the liquid phase for wet oxidation is readily apparent in the wet oxidation of solid fuels. Preferably the fuel is reduced to small particle size and is suspended in the wet medium, for example a slurry. An oxidizer then is introduced into the slurry and the process of wet oxidation is underway with a resultant generation of heat and a corresponding rise in temperature. If the wet medium is water, a modest increase in temperature without pressure restraint will result in the water converting into vapor. The loss of liquid will tend to destroy the slurry with the solids portion forming a cohesive mass that is virtually impervious to the continuation of oxidation at rates of commercial interest. Thus it is apparent that the process should be conducted in a pressure vessel and that the wet medium should be selected from inert liquids that have a critical temperature well above the maximum temperature planned for commercial operations.

We have found that there are several acceptable inert liquids among the family of fluorocarbons containing eight or more carbon atoms, that may be used as the wet medium for wet oxidation processes. These liquids have another desirable attribute in that they readily absorb large volumes of oxygen, and thus provide a vehicle for dispensing oxygen reasonably uniformly in a desirable manner, for example throughout a slurry. Further, these fluorocarbon liquids, once they have given up absorbed oxygen to the wet oxidation reaction, readily absorb more oxygen from an oxygen supply that is added, for example by bubbling a source of oxygen through the liquid fluorocarbon. In this manner the chemical oxygen demand can be met for a fuel suspended in the inert liquid.

Generally, it is preferable for the pressure vessel, sometimes called a reactor, to be in the general configuration of a cylinder with the longest dimension positioned in a vertical direction. In this orientation a substantial column of slurry can be maintained within the reactor with sufficient room for a gas cap in the top portion of the reactor.

The process of wet oxidation can be made continuous by providing means of injecting the slurry which is preferably composed of an inert carrier liquid with suspended solid fuel particles, by providing an oxidizer injection means capable of dispersing oxygen throughout the slurry, by providing an inert liquid withdrawal means near the top of the liquid column, and by providing a gas withdrawal means at or near the top of the reactor. Should the fuel oxidize into an ash residue it is preferable to provide a sludge withdrawal means at or near the bottom of the reactor. Since the wet oxidation process is exothermic, it is also preferable to install a heat exchanger within the reactor at an appropriate position, for example near the top of the liquid column within the reactor.

Many of the fuels of interest for the processes of the present invention are hydrocarbons. Upon wet oxidation, the hydrogen content of such fuels reacts with the oxidizer and forms water. It is preferable that the inert carrier liquid have a specific gravity greater than water so that water formed by reaction will float at the top of the liquid column. With water positioned in this manner, excess quantities may be removed from the reactor by a properly positioned water withdrawal means, and water that flashes to vapor readily becomes a part of the gas cap at the top of the reactor.

It is preferable that the fuel injection means, the inert liquid injection means and the oxidizer injection means be positioned at or near the bottom of the reactor. With the apparatus positioned as described heretofore, continuous operation of the reactor may be attained by balancing fluid injection rates with fluid withdrawal rates. Temperatures within the reactor may be controlled within planned limits by the use of the heat exchanger. Generally the temperatures should be controlled within the reactor within the range of 100° F. and the pressures should be controlled within the range of 30 psia to 3200 psia. For commercial application, however, the temperatures and pressures should be controlled in much narrower ranges, for example temperatures in the range of 250° F. to 500° F. and pressures in the range of 150 psia to 350 psia. In these narrower ranges in some cases water formed as a product of reaction will be in the liquid phase and in other cases water will be in the vapor phase. It is important that the inert liquid be selected so that in all cases of temperatures and pressures the inert liquid will remain in the liquid phase.

Preferably the heat receptive fluid injected into the heat exchanger is water which in turn is removed from the heat exchanger as steam. In the mode as described heretofore two fluids may be withdrawn from the reactor for further useful work; the gaseous products of reaction from wet oxidation and the steam from the heat exchanger. Both fluids contain a considerable amount of energy that can be converted into other forms. For example the fluids can be discharged through a turbine or through a reciprocating engine to accomplish mechanical work. Those of ordinary skill in the art can envision other useful purposes for the energy contained in the discharge fluids, including the heat contained in the inert liquid as well as in any liquid water withdrawn from the top of the liquid column within the reactor.

A wide variety of fuels may be used in the reactor with much of the available energy diverted to useful work in an adjacent engine, the combination of such apparatus sometimes being called a wet oxidation engine. The fuels may be common liquids such as petroleum derivatives or they may be solids such as coal, wood products, plastics and the like. Of particular interest as a fuel is municipal refuse—garbage and rubbish—which is accumulating at alarming rates in and around population centers.

Municipal refuse is generally not regarded highly as a fuel because of the wide variations in its content from batch to batch. Garbage, for example, has a relatively low combustible content generally ranging from 12% to 33% with relatively high moisture content generally ranging from 60% to 85%. In the United States, with widespread usage of household and restaurant waste food grinders, most of the garbage is disposed of through the sewer system rather than accumulating for periodic collection. As a result most of the municipal refuse is composed of rubbish—paper, rags, wood, plastics, glass and metals. It is not unusual in the United States to find municipal refuse that over long periods of times averages 80% combustibles, 13% noncombustibles and 7% ash. With rising costs of energy, the heat value of municipal refuse can be a viable alternate source of energy.

In the United States the two common disposal methods for municipal refuse are by interment in a so-called sanitary land fill and by incineration. In the land fill procedure destruction of the refuse is delayed over a long time period with the resultant underground generation of carbon dioxide and methane. Migration of the methane can cause an unplanned hazardous situation when explosive concentrations accumulate in storm sewers and other void spaces underground. In the incineration procedure refuse is set afire and reduced to ash. The hetrogeneous nature of refuse considerably complicates the problem of complete combustion and great care is required to avoid release of objectionable odors and particulate matter. Considerable improvement over both methods of disposal can be accomplished by wet oxidation of refuse to residual ash, as will be more fully described hereinafter.

The heat content of municipal refuse typically averages in the range of 7,000 to 9,000 BTU per pound on a dry basis. On an as-received basis the average heat content approximates 4,000 BTU/Lb. While the components of refuse vary widely from batch to batch, the chemical composition of combustible material approximates $C_6H_{10}O_5$. Manual sorting and segregation of refuse into combustibles and noncombustibles is an unpleasant and costly task. Therefore, it is highly desirable to proceed with refuse disposal in an environmentally acceptable way without the manual sorting step.

With approximately 4,000 BTU per pound of heat available from refuse, on an as received basis a portion of this available energy can be applied to proper preparation of the material for destruction. The balance of the available energy can then be directed to further useful work. It is well known in the art how to shred and compact loose bulky material, and no useful purpose is accomplished by detailing such procedures herein. For the methods of the present invention it is preferred that the refuse be reduced in size to units of compact material with maximum dimension of approximately one-half inch. Such sizing and compaction may be accomplished by any convenient method and it is preferable that any liquid residue be disposed of separately. The resulting compacted units of residue will be relatively free of moisture and will be composed of combustibles and noncombustibles.

In some cases it is desirable that substantially all of the moisture be removed from the rubbish with the resultant increase in BTU content per pound of rubbish. Methods of drying are well known in the art, with the choice of methods being dictated in part by economic considerations.

One method of interest involves the displacement of water by an oily fluid. Preferably the oily fluid would be the inert carrier liquid used in the reactor of the present invention.

As mentioned heretofore many fuels can be used in the methods of the present invention. For illustrative purposes the fuel described is compacted municipal refuse. The methods of the present invention can be more clearly understood by reference to the drawings.

SUMMARY OF THE INVENTION

A reactor vessel is established wherein a fuel is wet oxidized to residue. Products of reaction are directed through a prime mover to create mechanical work. Exothermic heat is captured in part to raise steam which is directed to a prime mover to create mechanical work.

BRIEF DESCRIPTION OF THE PREFERRED EMBODIMENTS

Figure 1:
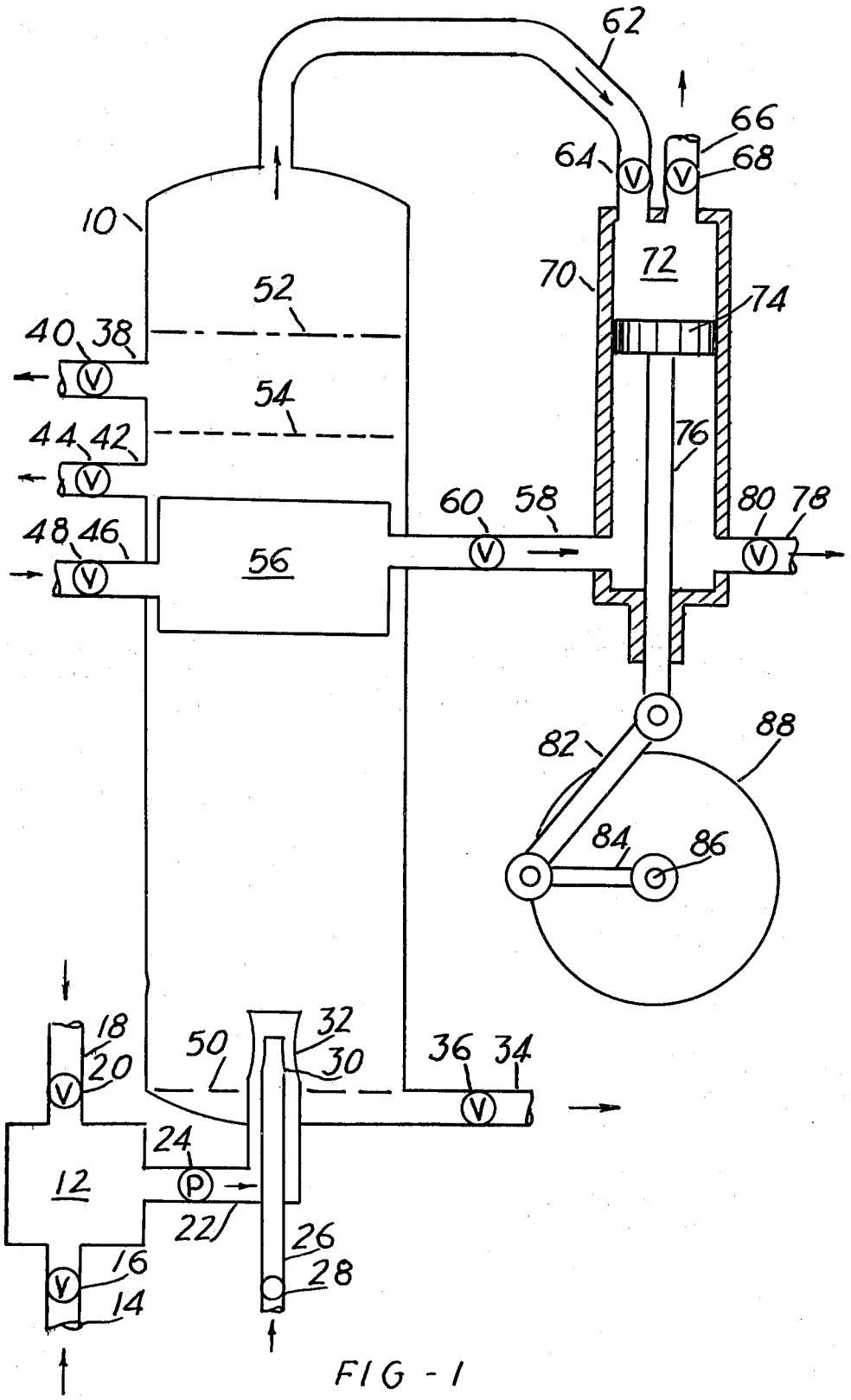
FIG. 1 is a diagrammatical vertical section showing the arrangement of apparatus for the methods of the invention in one embodiment.

Referring first to FIG. 1, a reactor 10 is established to operate at superatmospheric temperatures and pressures. Preferably reactor 10 is cylindrical in configuration with a diameter of six feet and a length of 100 feet. Preferably the fuel is introduced into reactor 10 as a slurry which is formed in mixer 12 which contains inert carrier inlet line 18 and fuel inlet line 14. The slurry can be mixed in any convenient manner and preferably is composed of 20% solid fuel by weight when the fuel selected is municipal refuse. Those skilled in the art will recognize that the slurry may vary, depending on the fuel selected, in the range of 5% to 80% solids by weight. The inert carrier liquid preferably is tri(perfluorooctyl) amine $(C_8F_{17})_3N$. Upon establishing the preferred slurry the mixture is heated by any convenient method to a temperature near that of the planned operating temperature within the reactor, for example 330° F. The fuel in the form of municipal refuse preferably has been partially dried so that its heat content approximates 6,000 BTU per pound.

The slurry is injected under pressure into reactor 10 via flow line 22 by means of pump 24, with the discharge into reactor 10 preferably being accomplished through venturi 32. The preferred pressure within reactor 10 is 150 psig as measured at the liquid-gas interface 52. The rate of injection of the slurry preferably is five tons per hour of injected muncicipal refuse.

An appropriate amount of oxygen to fulfill the chemical oxygen demand of the municipal refuse is injected into reactor 10 via flow line 26. The discharge of the source of oxygen preferably is through nozzle 30 which is positioned within venturi 32. The inert carrier liquid has an affinity for oxygen and thus provides a means of reasonably uniform dispersion of oxygen throughout the reaction zone in reactor 10 between the sludge-liquid interface 52 and the carrier liquid-water interface 54. The intimate mixing afforded by nozzle 30 within venturi 32 further induces contact of the fuel and oxygen within the wet medium provided by the inert carrier liquid.

Wet oxidation of the fuel is an exothermic reaction that causes a rapid buildup of temperature within reactor 10 unless the surplus heat is removed. Preferably the surplus heat is removed from reactor 10 by heat exchanger 56. Such heat can be removed, for example by injecting water into flow line 46 and removing steam through flow line 58.

The reactor is filled with inert carrier liquid to an appropriate point in reactor 10, for example level 54. After the fuel portion of the slurry has been oxidized, the stripped inert carrier liquid is withdrawn from reactor 10 via flow line 42 for recycling. The heavy portion of the residual ash settles to the bottom of reactor 10 and forms a sludge. The sludge is withdrawn continuously or intermittently via flow line 34.

Upon complete oxidation of the fuel the hydrogen portion will combine with oxygen to form water and the carbon portion will combine with oxygen to form carbon dioxide. Since water has a lower specific gravity than the preferred inert carrier liquid, water will accumulate in the liquid phase between the interfaces 54 and 52. Water may then be withdrawn from the reactor 10 via flow line 38. Water thus withdrawn preferably is directed into heat exchanger 56 via flow line 46 where the water is converted into steam. Water generated as a product of wet oxidation that remains as a vapor will accumulate in the gas cap located above interface 52. The carbon dioxides generated will also accumulate in the gas cap above interface 52. Should air or oxygen enriched air be used as the source of oxygen, nitrogen will not enter into the reactions and thus also will accumulate in the gas cap above interface 52.

With the continuous injection of slurry into reactor 10, gases or vapors generated as products of reaction must also be continuously withdrawn. These fluids under pressure at elevated temperatures contain substantial amounts of energy which can be converted into useful work. Likewise the steam generated in heat exchanger 56 also contains considerable energy.

As shown in FIG. 1 a prime mover apparatus 70 is used to convert the energy of generated fluids into mechanical work. Prime mover 70 is a double acting reciprocating engine. A piston 74 is contained inside cylinder 72 and is connected to flywheel 88 by piston rod 76, connecting rod 82 and crankshaft 84. For the downstroke of the piston valves 60 and 68 are closed with valves 64 and 80 open. Generated fluids from reactor 10 actuate the piston for the downstroke. For the upstroke valves 64 and 80 are closed and valves 60 and 68 are open. Steam from heat exchanger 56 actuates the piston on the upstroke.

Figure 2:
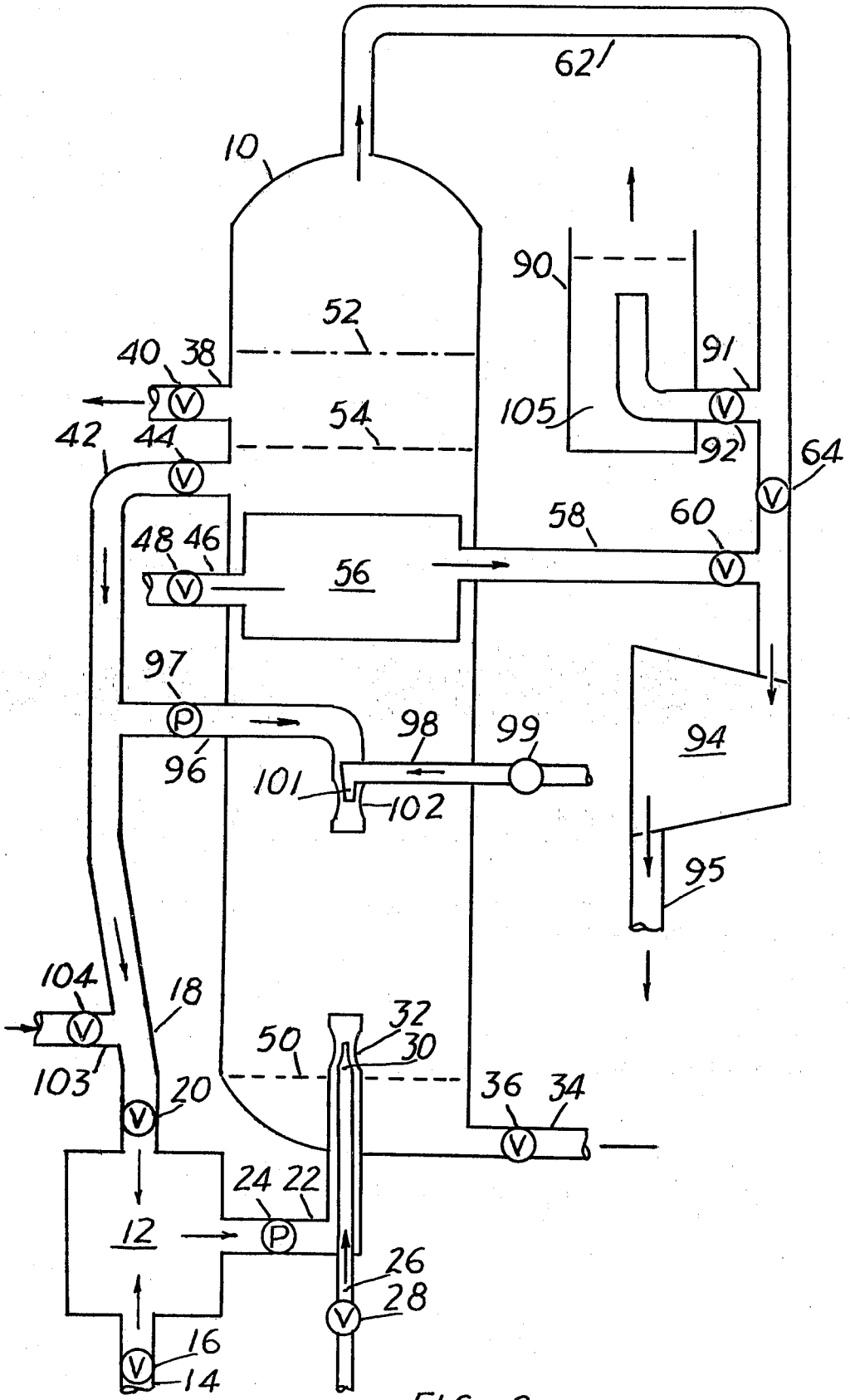
FIG. 2 is a diagrammatical vertical section showing the arrangement of apparatus for the methods of the invention in another embodiment.

Referring now to FIG. 2, a reactor 10 similar to the reactor shown in FIG. 1 is modified by adding within reactor 10 a second injection device that is useful when a portion of the fuel is not completely oxidized in the first pass through the reactor and to induce greater turbulence within the reaction zone between interfaces 50 and 54. In this mode the diluted slurry of inert carrier liquid and remaining unoxidized fuel is withdrawn from the reactor via flow line 42 and reinjected into the reactor via flow line 96 through venturi 102. A source of oxygen is injected via flow line 98 through nozzle 101.

With the apparatus arranged as illustrated by FIG. 2, the process begins by injecting inert carrier liquid via flow line 103 into mixer 12 where a slurry is formed by any convenient means with fuel injected via flow line 14. The reactor is brought up to operating conditions as heretofore described. When the inert carrier liquid level reaches interface 54, withdrawn inert carrier liquid via flow line 42 may be directed through flow line 96 for a second pass through the reactor or the inert carrier liquid may be directed to mixer 12. In either case valve 104 would normally be closed at this point in the sequence. By withdrawing sludge via flow line 34 a portion of the inert carrier liquid will be withdrawn from reactor 10. A corresponding amount of inert carier liquid should then be added to reactor 10 via flow line 103.

As illustrated in FIG. 2 two types of prime movers are shown, a gas lift pump 90 and a turbine 94. The gas lift pump is actuated by directing generated fluids from reactor 10 via flow line 62 into flow line 91 which is immersed in liquid 105. Thus the energy of generated fluids from reactor 10 can be used to lift liquid 105. Turbine 94 can be energized by generated fluids from reactor 10 via flow line 62 with valve 64 open and valves 60 and 92 closed. Tubine 94 can be energized by steam from heat exchanger 56 with valve 60 open and valve 64 closed. Turbine 94 also can be energized by a combination of steam from heat exchanger 56 and generated fluids from reactor 10.

Depending on the fuel selected it is possible that the ash residue of wet oxidation may be finely divided to the extent that it will not settle out as a sludge below interface 50. In such case the ash will remain suspended in the inert carrier liquid. It is preferable that such suspended ash be removed from the carrier liquid by any convenient means, for example a filter (not shown) in flow line 42.

Thus it may be seen that a fuel can be wet oxidized to the completion of the chemical oxygen demand in an inert carrier liquid, that a substantial portion of the exothermic heat of reaction can be converted into mechanical energy, that the gaseous products of reaction can be converted into mechanical work, and that a nuisance material such as municipal refuse can serve as the fuel. While the present invention has been described with a certain degree of particularity it is understood that the description has been made by way of example and that modifications in details of structure may be made without departing from the spirit thereof.

What is claimed is:

1. A method of coupling a wet oxidation reactor to an engine so that the gaseous products of wet oxidation reactions can be converted into mechanical work, comprising the steps of injecting a mixture of fuel and an inert liquid into the reactor, injecting an oxidizer into the reactor, establishing superatmospheric pressure within the reactor, establishing superambient temperature within the reactor, wet oxidizing the fuel to residue, withdrawing the gaseous products of wet oxidation reactions from the reactor, and diverting the gaseous products of wet oxidation reactions through an engine with the resultant generation of mechanical work, wherein the said inert liquid is a fluorocarbon with eight or more carbon atoms.

2. The method of claim 1 further including the steps of removing a portion of the heat of wet oxidation reactions from the reactor, such heat being transferred to water and converting the water to steam, then diverting the said steam through an engine with the resultant generation of mechanical work.

3. The method of claim 1 wherein the said oxidizer is selected from the group comprised of air, oxygen-enriched air and oxygen.

4. The method of claim 1 wherein the said engine is a device selected from the group comprised of reciprocating engine, turbine and gas lift pump.

5. The method of claim 1 wherein the said superatmospheric pressure is maintained in the range of 30 psia and 3200 psia and the said superambient temperature is maintained within the range of 100° F. and 610° F.

6. The method of claim 1 wherein a portion of the said residue is water and further including the step of withdrawing the said water from the reactor.

7. The method of claim 1 wherein a portion of the said residue is ash and further including the step of withdrawing the said ash from the reactor.

8. A method of coupling a wet oxidation reactor to an engine so that the gaseous products of wet oxidation reactions can be converted into mechanical work, comprising the steps of injecting a mixture of fuel and an inert liquid into the reactor, injecting an oxidizer into the reactor, establishing superatmospheric pressure within the reactor, establishing superambient temperature within the reactor, wet oxidizing the fuel to residue.

withdrawing the gaseous products of wet oxidation reactions from the reactor, diverting the gaseous products of wet oxidation reactions through an engine with the resultant generation of mechanical work, withdrawing a portion of the said mixture of fuel and an inert liquid from the reactor, then reinjecting the said mixture of fuel and inert liquid into the reactor.

9. The method of claim 8 wherein the said fuel is selected from the group comprised of hydrocarbons, petroleum derivatives, coal, wood products, plastics and municipal refuse.

10. The method of claim 8 further including the steps of removing a portion of the heat of wet oxidation reactions from the reactor, such heat being transferred to water and converting the water to steam, then diverting the said steam through an engine with the resultant generation of mechanical work.

* * * * *